US011297955B2

(12) United States Patent
Fischer

(10) Patent No.: US 11,297,955 B2
(45) Date of Patent: Apr. 12, 2022

(54) SEATING, IN PARTICULAR A HIGH-CHAIR FOR CHILDREN

(71) Applicant: CYBEX GmbH, Bayreuth (DE)

(72) Inventor: Wolfram Fischer, Bayreuth (DE)

(73) Assignee: CYBEX GmbH, Bayreuth (DE)

( * ) Notice: Subject to any disclaimer, the term of this patent is extended or adjusted under 35 U.S.C. 154(b) by 0 days.

(21) Appl. No.: 16/638,052

(22) PCT Filed: Aug. 6, 2018

(86) PCT No.: PCT/EP2018/071245
§ 371 (c)(1),
(2) Date: Feb. 10, 2020

(87) PCT Pub. No.: WO2019/030162
PCT Pub. Date: Feb. 14, 2019

(65) Prior Publication Data

US 2020/0214468 A1 Jul. 9, 2020

(30) Foreign Application Priority Data

Aug. 10, 2017 (DE) ..... 20 2017 104 829.2
Nov. 8, 2017 (DE) ..... 20 2017 106 758.0

(51) Int. Cl.
*A47D 1/00* (2006.01)

(52) U.S. Cl.
CPC ..... *A47D 1/004* (2013.01)

(58) Field of Classification Search
CPC ..... A47D 1/004; B62B 2206/03
USPC ..... 297/344.12, 344.18
See application file for complete search history.

(56) References Cited

U.S. PATENT DOCUMENTS

| | | | | |
|---|---|---|---|---|
| 4,722,570 | A | 2/1988 | Bertoli | |
| 5,165,755 | A | 11/1992 | Rho | |
| 5,238,292 | A | 8/1993 | Golenz et al. | |
| 5,332,241 | A | 7/1994 | Rho | |
| 5,445,432 | A * | 8/1995 | Chien | A47D 1/023 297/344.18 |
| 7,810,885 | B2 * | 10/2010 | Chen | A47D 1/004 297/344.18 |
| 8,029,014 | B2 * | 10/2011 | Ahnert | B62B 9/104 280/650 |

(Continued)

FOREIGN PATENT DOCUMENTS

| | | |
|---|---|---|
| DE | 69009806 | 9/1994 |
| DE | 19610714 A1 | 9/1997 |

(Continued)

OTHER PUBLICATIONS

"International Application No. PCT/EP2018/071245, International Search Report and Written Opinion dated Sep. 27, 2018", (dated Sep. 27, 2018), 14 pgs.

(Continued)

*Primary Examiner* — Sarah B McPartlin
(74) *Attorney, Agent, or Firm* — Schwegman Lundberg & Woessner, P.A.

(57) ABSTRACT

The invention relates to a high-chair for children, comprising a height-adjustable support system for supporting a part of the body of the child, said support system comprising a height-adjustment system having a locking system that locks an adjusted height, at least in part, and more particularly predominantly, by a frictional connection.

15 Claims, 4 Drawing Sheets

(56) References Cited

U.S. PATENT DOCUMENTS

| | | | | |
|---|---|---|---|---|
| 8,696,055 | B2 * | 4/2014 | Stolarz | A47D 1/0081 297/149 |
| 2009/0026823 | A1 * | 1/2009 | Driessen | A47D 1/004 297/344.14 |
| 2011/0254336 | A1 * | 10/2011 | Ponticelli | A47D 11/02 297/344.12 |
| 2013/0277949 | A1 * | 10/2013 | Yin | B60N 2/1685 280/658 |
| 2015/0366372 | A1 * | 12/2015 | Lei | A47D 1/004 280/638 |

FOREIGN PATENT DOCUMENTS

| | | |
|---|---|---|
| DE | 29918648 | 1/2000 |
| DE | 20307043 | 9/2003 |
| JP | S5755356 | 3/1982 |
| WO | WO-2019030162 A1 | 2/2019 |

OTHER PUBLICATIONS

"International Application No. PCT/EP2018/071245, English Translation of International Preliminary Report on Patentability dated Feb. 20, 2020", (dated Feb. 20, 2020), 9 pgs.

* cited by examiner

SEATING, IN PARTICULAR A HIGH-CHAIR FOR CHILDREN

PRIORITY CLAIM TO RELATED APPLICATIONS

This application is a U.S. national stage filing under 35 U.S.C. § 371 of International Application No. PCT/EP2018/071245, filed on 6 Aug. 2018, and published as WO2019/030162 on 14 Feb. 2019, which claims priority to German Application No. 20 2017 104 829.2, filed on 10 Aug. 2017, and to German Application No. 20 2017 106 758.0, filed on 8 Nov. 2017, the benefit of priority of each of which is claimed herein, and which applications and publication are hereby incorporated herein by reference in their entirety.

DESCRIPTION

The invention relates to seating, particularly a high chair for children.

High chairs for children (chairs for children) have been known for a long time and in various configurations. Typically, high chairs of this type have a frame with a pair of front chair legs and a pair of rear chair legs (or alternatively for example only two chair legs, which are correspondingly widened at their lower end, in order to ensure a stable footing) and a seat with a seating surface and a backrest. Armrests, a foot rest, a tray and the like may be provided as additional elements. The frame (with or without seating surface) may, if appropriate, be foldable, in order to enable a use position and a (more compact) folded position.

The seat may be in a fixed position with respect to the frame or adjustable with regards to the height, wherein either the entire seat is adjusted or individual components, such as for example the seating surface and/or the backrest and/or the foot rest are adjusted (which can then be adjusted independently of one another if appropriate). In the prior art, it is furthermore conventional that (in the case of height-adjustable high chairs) a certain number of predetermined positions (height positions) for the adjustable components is enabled, for example by means of the construction of holes at suitable positions of the frame and (retractable) pins on the component to be adjusted.

An adjustable child seat is known for example from DE 690 09 806 T2. According to DE 690 098 06 T2, two pins (one in each case on a side of the child chair) are provided for height adjustment, which pins can assume different, discrete positions in a guide path, so that the high chair can be adjusted according to height. In principle, similar solutions are known from U.S. Pat. Nos. 5,238,292 A and 4,722,570 A. In U.S. Pat. No. 5,238,292 A, bolt elements are provided, which can be brought into engagement with corresponding ribs, so that the height can likewise be adjusted. U.S. Pat. No. 4,722,570 A describes hook elements, which can interact with latching elements, likewise in order to undertake a discrete height adjustment. Overall, these solutions in the prior art are found to be comparatively complex in terms of design and handling and of comparatively little flexibility in particular.

It is therefore the object of the invention to suggest seating, particularly a child chair, preferably high chair for children (child chair) with an adjustable support device for supporting a body part of a child, wherein an adjustment of the height should be enabled in a simple and particularly flexible manner.

This object is achieved by means of seating, particularly a high chair.

In particular, the object is achieved by seating, particularly a child chair, preferably a high chair for children with a height-adjustable support device for supporting a body part and/or an external object of the child, such as e.g. a drinking bottle or a toy, wherein the height-adjustment device comprises a locking device, which effects locking of an adjusted height, at least proportionally, particularly predominantly, by means of a force connection (particularly by means of a press fit and/or clamping).

According to a further optionally independent aspect (but which may in particular be combined with the above aspect relating to the force connection), the above object is achieved in particular by means of seating, particularly a child chair, preferably a high chair for children with a height-adjustable support device for supporting a body part of the child, comprising a height-adjustment device, which is configured for infinitely variable height adjustment of the support device.

A core idea of the invention lies in locking a certain height (of a height-adjustable support device) at least proportionally (particularly predominantly) by means of a force connection (e.g. frictional connection). In a force connection, a normal force of surfaces, which are to lock with respect to one another, is present. Overcoming the locking is only possible if an applied force exceeds the counter-force effected by the static friction. To differentiate from force connection, in a positive connection, at least two parts to be connected engage in one another. As a result, in the case of positive connection, the parts to be connected cannot even be detached from one another without or in the case of interrupted force transmission. Expressed differently, in a positive-fitting connection, the one part to be connected is in the way of the other. In the case of operational stress, pressure forces act normally, i.e. at right angles to the surfaces of the parts to be connected. Positive connections of this type are for example described in U.S. Pat. Nos. 4,722,570 A, 5,238,292 A and DE 690 09 806 T2.

It is not absolutely necessary that the provided force connection alone can maintain the locking (which is preferably provided as such however). In each case, however, the locking device is configured in such a manner that locking can only be maintained (in the event of loading) if the force connection is also acting. In other words, locking is only maintained then if the force connection is acting or not maintained then if one at least mentally removes the force connection, (or at least allows the retaining force of the force connection to be at least mentally discounted). This should at least be true for a state of the respective support device, in which the unladen weight of the support device is acting. Insofar as the support device is a seating surface (and/or a foot rest) or comprises one such, an additional loading of preferably at least 5 kg, further preferably at least 10 kg (as weight of the child) may be taken into account here.

An upper limit for the weight to be added (simulating the child) on the support device may be <60 kg, preferably <40 kg. For example, in a range of 5 kg to 60 kg, locking should therefore at least also be brought about by the force connection (in the sense that the locking would not hold without the force connection at least in sections of this range). Preferably, a force, which can be compensated by the force connection (in the locked state) is >50 newtons, further preferably >200 newtons, more preferably >300 newtons. Predominantly, the locking should be effected by the force connection in particular if at least 50%, preferably at least 80% of a retaining force (particularly under the above-mentioned circumstances, for example relating to an additional weight by means of a child sitting in the chair) is applied. As a whole, the locking is effected by means of the force connection then if the entire force can be compensated by the force connection (or the locking can be maintained by means of the force connection).

The height-adjustment device is preferably configured in such a manner that an adjustment is enabled within a height difference (in the vertical direction) of at least 5 cm, preferably at least 10 cm, yet further preferably at least 15 cm. The height adjustment is preferably infinitely variable then if any desired height values can be set within this height difference (or at least height values which have a spacing of <2 mm, particularly <0.5 mm from one another). Fundamentally, a first height adjustment range can also be provided, in which the height can be adjusted in an infinitely variable manner and a second height adjustment range, in which only a discrete height adjustment is possible. In one embodiment however, an infinitely variable height adjustment may be enabled over the entire height adjustment range (of the respective support device). If, in addition to an infinitely-variably adjustable height range, an only discretely adjustable height range is also present, a height difference of the infinitely-variably adjustable height range (in the vertical direction) is in particular at least 2 cm, further preferably at least 5 cm, yet further preferably at least 10 cm.

In the embodiment, the locking device can be configured in such a manner that it effects the locking of the adjusted height, at least proportionally, particularly predominantly, by means of a press fit and/or clamping. A press fit is in particular to be understood to mean a configuration in which a force acts (for example by means of a spring) in the direction of one or more adhesive surfaces, so that the mutually adhering surfaces are pressed against one another. For example, a projection or pin (or the like) can be pressed into a corresponding recess here. Clamping (or a corresponding clamping device) is in particular to be understood to mean a device, which acts in such a manner that an increase of the loading force (for example if a child climbs onto the seating, particularly the high chair) effects an increase of the force owing to the force connection (frictional force) (comparable to a wedge clamped under a door gap). A secure application is enabled in a simple manner by measures of this type.

The support device may comprise a seating surface and/or a backrest and/or a foot rest and/or an armrest and/or a tray (for drinking cups and the like).

The locking device may comprise (at least) one locking groove and at least one bolt element, which can be guided into and out of the locking groove. The bolt element is preferably secured inside the locking groove in the locked state by means of a press fit and/or clamping. An infinitely variable adjustment of the locking can be enabled in a simple manner using a configuration of this type. The locking groove can be arranged on a main body (e.g. frame) of the seating, particularly high chair, and the (at least one) bolt element can be arranged on the support device, or vice versa. The replaceability of the arrangement by components which can be connected to one another by means of force connection also applies fundamentally for other possible configurations of the invention (as explained below for example).

Locking can preferably be produced or released by rotation of a/the bolt element and/or by means of a translational movement of a/the bolt element. For example, the bolt element can be rotated into the locking groove, in order to effect locking. As a result, locking can be enabled in a simple manner.

Preferably, the actuating element is pretensioned, particularly in the direction of a locking position (or in a direction in which the actuating element is forced into the locking position by means of a pretensioning force). The handling is simplified further as a result.

In an embodiment, locking can be produced and/or released by rotation of an actuating element and/or by means of a translational movement of an actuating element. An actuating element is in particular understood to mean a handling device (e.g. comprising a handle), which is accessible from outside, so that a user can grip it (for releasing or producing the locking). A handling device of this type can for example be arranged in a central region of the seating, particularly high chair. If appropriate, at least two or even more locking devices can be actuated (so that locking is released or produced) by means of one and the same actuating element (or handling device). Actuating element and bolt element may be in operative connection with one another via a connecting device (which may if appropriate be movable in a translational or purely translational manner).

In an actual embodiment, the actuating element is rotatable and arranged in such a manner that it drives a (translationally movable) connecting device, which then in turn rotates one (or more) bolt elements for producing or releasing the locking. Releasing or producing the locking can be enabled in a simple manner using a configuration of this type.

In a preferred embodiment, a pretensioning, particularly spring device, is provided, which preferably acts in the direction of a locked state. Alternatively, a spring device (if appropriate a further spring device) can also be provided, which acts in the direction of a non-locked state. If a pretensioning, particularly spring device, is provided, which acts in the direction of a locked state, locking can be produced and maintained in a simple (and secure) manner. In particular, a predefined force, which is not dependent on the respective use situation (e.g. weight of the child), is present due to a pretensioning, particularly spring device, of this type.

The height adjustment is preferably positively guided. The handling is simplified as a result. A positive guiding of this type can for example comprise a rail and/or groove and/or slide.

In an actual embodiment, a guide groove is provided for guiding a height adjustment. In this case, the guide groove is preferably constructed at least partially by the above-described locking groove (or vice versa). In particular, the guide and/or locking groove is constructed in such a manner that the above-described bolt element can slide in the guide or locking groove in the non-locked state.

Alternatively or additionally, a (further) slide element may be provided, which can slide in the guide or locking groove (for guiding or controlling the height adjustment). The slide element is provided additionally to the bolt element in particular. The slide element may be constructed as a small (if appropriate concave, particularly cylinder-surface-section shaped) plate (that is to say a small slide plate), which can correspondingly be moved in the groove. In the locking position in particular (if appropriate, also in the non-locked position), the bolt element preferably penetrates the slide element (particularly an opening in the same, which may be of slot-shaped construction for example). Overall, the handling is simplified as a result.

If, generally, a bolt element, which can be guided into and out of the locking groove, is provided, this does not necessarily mean that the bolt element has to be moved completely out of the locking groove (which may be however), but rather it is sufficient in this sense if the bolt element can be guided at least partially out of the locking groove (particularly in the sense that a distal end of the bolt element can be removed further from a groove base).

A simple adjustment and locking can be achieved in a constructively simpler realization by means of a combined guide and locking groove.

The locking device can be arranged and configured in such a manner that the gravity (of the support device itself and if appropriate a child arranged on the support device) at least supports the locking. The gravity can for example be conducted (diverted) in such a manner that it effects an increase of the normal force of surfaces resting in static friction with one another.

In an embodiment, the locking device has two bolt elements (which can preferably be rotated in opposite direction. The two bolt elements may, if appropriate, engage into the same recess (e.g. groove). The two rotatable bolt elements are preferably positively guided in such a manner in this case (for example by means of a common bearing surface at proximal ends of the bolt elements), that they can only be rotated together. Preferably, the two bolt elements are mounted on a common shaft.

Generally, one or more bolt elements can be mounted on the rotational shaft, which is stationary with respect to a main body (e.g. frame) of the seating, particularly a high chair. If two bolt elements (which can be rotated in opposite direction in particular) are provided, it may be provided in particular that a first bolt element (at least predominantly) enables locking with respect to a movement downwards and a second bolt element (at least predominantly) enables locking with respect to a movement upwards. Furthermore, it may be the case that due to the rotation of the bolt elements (for example by means of a rotation towards one another of the bolt elements), a further force is enabled (e.g. owing to spreading), which improves the locking again.

The one or the plurality of bolt elements can be constructed to be wedge-shaped or, if appropriate, flat in cross section (particularly a radial section). A plurality of locking devices may be provided per support device, preferably two, in particular one on each side of the seating, particularly a high chair. Reliable locking may be enabled as a result.

In a preferred embodiment, the height adjustment and/or the locking of the adjusted height and/or the ending of the locking of the adjusted height can be carried out one-handed. Preferably, both the height adjustment and the locking of the adjusted height and the ending of the locking of the adjusted height can take place by gripping and operating a (single) handle. For example, the height adjustment may take place by lifting or lowering the handle (or allowing the handle to drop) (that is to say generally, if appropriate, by means of a translational movement) and the locking of the adjusted height or the ending of the locking of the adjusted height by means of a rotation of the handle. The handle as such is preferably formed in one piece or monolithically. Furthermore, the handle can be arranged centrally. Furthermore, the handle may have a concave outer surface (for gripping). A size (length) of the handle may be at least 5 cm, preferably at least 10 cm, and/or at most 30 cm, preferably at most 20 cm. Overall, the handling of the child seat is simplified considerably.

At least one or more bolt elements are preferably rotated downwards (at least in the locked state, if appropriate, in all possible states). This means that an applied load, which is for example acting on the shaft, about which the respective bolt element can be pivoted, leads to a further stretching (pivoting upwards) of the bolt element, so that the bolt element fundamentally pivots further outwards and thus an adhesion force (frictional force) is increased. As a result, the effect of an applied load can be used in a simple manner to increase the locking force.

According to the invention, seating, particularly a high chair, is suggested, which has a height-adjustable component, wherein locking (fixing) of the height adjustment can preferably be effected by means of a clamping device (clamping element). The clamping device (acting like a wedge in particular) may be arranged and constructed on a main body of the seating, particularly a high chair (e.g. frame), in order to be brought into engagement with the height-adjustable component—or vice versa. As a result, the lock (clamping device) can be brought into a locking position, in which a relative movement between main body of the seating, particularly a high chair and height-adjustable component is prevented, or into a released state, where a relative movement of this type is enabled. A transition between the locked state and the released state is preferably enabled by means of a rotation, but can also take place in a translational manner. Preferably, a clamping device or a bolt element is pretensioned in the direction of the locking state, for example by means of a spring or another (suitable pretensioning device).

In a preferred embodiment of the invention, a relative movement is controlled between main body of the seating, particularly high chair, and height-adjustable component, so that the relative movement follows (or must follow) a predetermined trajectory. A continuous (infinitely variable) positioning may be possible on this trajectory. A groove on the element (either main body or height-adjustable component) may be provided as guide means, which does not comprise the spring element (or the clamping device). In the locked state, the bolt element (or the clamping device) can be brought into engagement with an inner surface of the groove. Preferably, in the released state, the bolt element (or the clamping device) can be moved in the groove, without being locked.

In a preferred embodiment of the invention, a transition of the bolt element (or the clamping device) from a released state to a locked state can preferably take place by means of rotation. The rotation preferably takes place in such a manner (or in such a direction of rotation), that a force in the direction of gravity (or along a guiding device, such as a guide groove for example) effects the engagement (the locking) at least partially (if appropriate, completely). Alternatively or additionally, if appropriate, two bolt elements (clamping devices) may be provided, which, if appropriate, can be rotated in different directions, so that for each force (with a component in a direction of a possible movement), at least one of the bolt elements (or clamping devices) effects locking.

Generally, it is possible that the seating, particularly of the high chair or the height-adjustable component is equipped with two or more bolt elements (clamping devices or locking devices) or corresponding pairs of bolt elements (or clamping devices), which can be released and/or transitioned into the locked state by means of a common mechanism.

Further embodiments of the invention emerge from the dependent claims.

The seating, particularly the high chair may have a frame, if appropriate, with a pair of front chair legs and a pair of rear chair legs (or alternatively for example only three or only two chair legs, which, if appropriate, are correspondingly widened at their lower end, in order to ensure a stable footing) and a seat with a seating surface and optionally a backrest. Armrests, a foot rest and/or a tray may be provided as additional elements. The frame (with or without seating surface) may, if appropriate, be foldable, in order to enable a use position and a (more compact) folded position.

The invention comprises not only a height adjustment (even if the present invention is particularly advantageous for a height adjustment, as it matters in particular here that the child or other objects can be positioned as precisely as possible), but rather generally also an adjustment of such a position of the support device, particularly a depth adjustment (i.e. an adjustment of the support device further forwards or further rearwards in particular). In this respect, in the above and in the following, "height adjustment" can be replaced by "height and/or depth adjustment" where it is not (or at least not decisively) dependent on an alignment of the respective adjustment option (as is the case for example when utilizing gravity). Furthermore, details such as "upwards" or "downwards" can then be replaced by "forwards" or "downwards".

Overall, in contrast to the prior art, not only can discrete (predetermined) positions of the height adjustment be achieved, but rather an infinitely variable adjustment can be carried out. As a result, costs for material and production can also be reduced, as separate elements, such as latching recesses or the like, do not necessarily have to be present (as in the prior art) for the individual predetermined positions. Overall, a height adjustment device is enabled, which allows an infinitely variable height adjustment of an adjustable component and which can also securely hold a certain adjustment position, wherein the production costs are comparatively low at the same time.

In the following, the invention is described on the basis of an exemplary embodiment, which is explained in more detail on the basis of the figures. In the figures.

In the following description, the same reference numbers are used for identical and identically acting parts.

Figure 1:
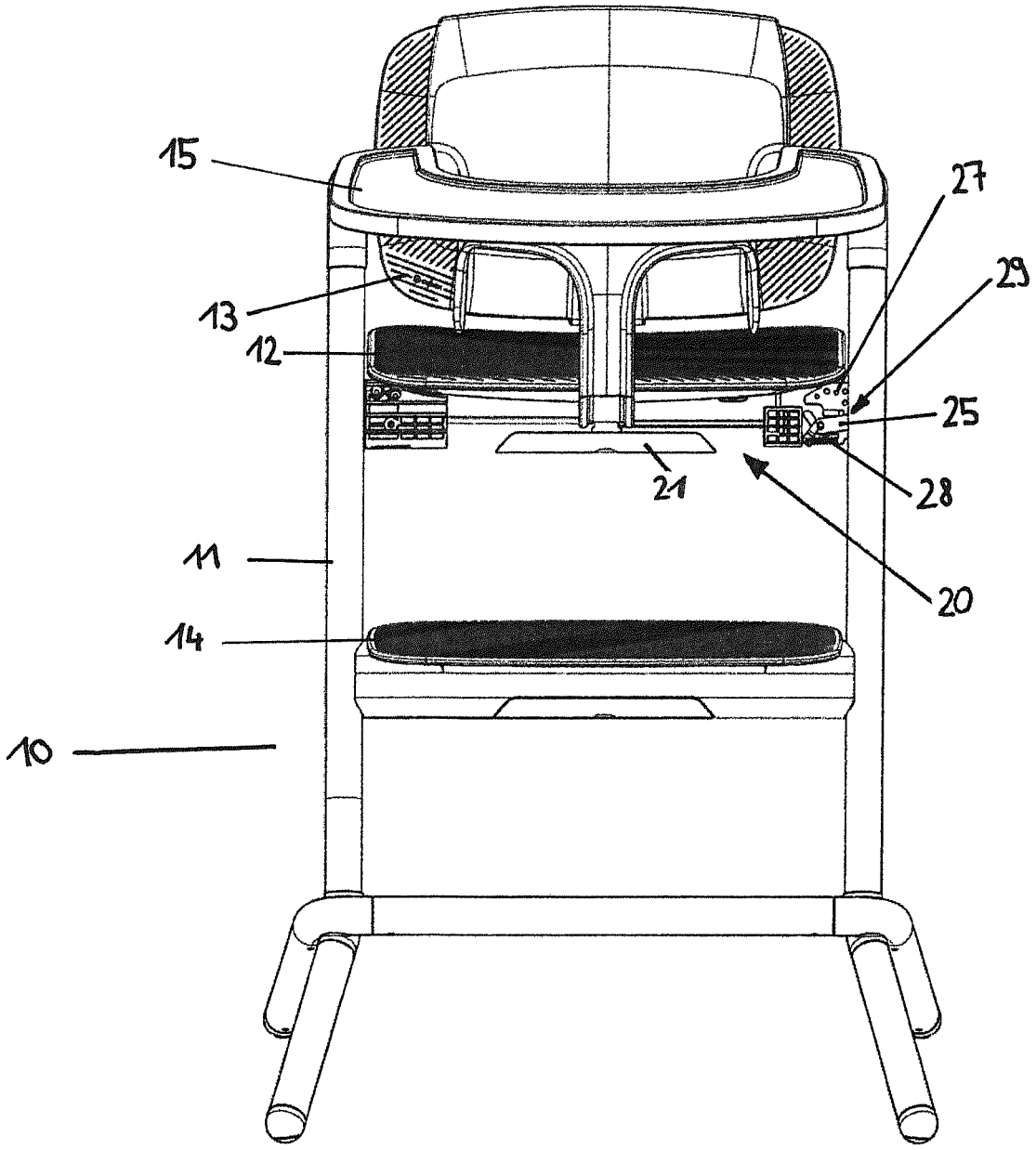
FIG. 1 shows a schematic front view of a high chair according to the invention with partially transparently illustrated areas.

FIG. 1 shows a high chair 10 with legs 11, a seating surface 12, a backrest 13, a foot rest 14 and a tray 15.

The seating surface 12 and the foot rest 14 are adjustable (independently of one another) with regards to their height with respect to the legs 11. The mechanism for height adjustment is analogous for the seating surface 12 and the foot rest 14, so that in the following, only the mechanism for the height adjustment of the seating surface 12 is explained in detail.

Figure 2:
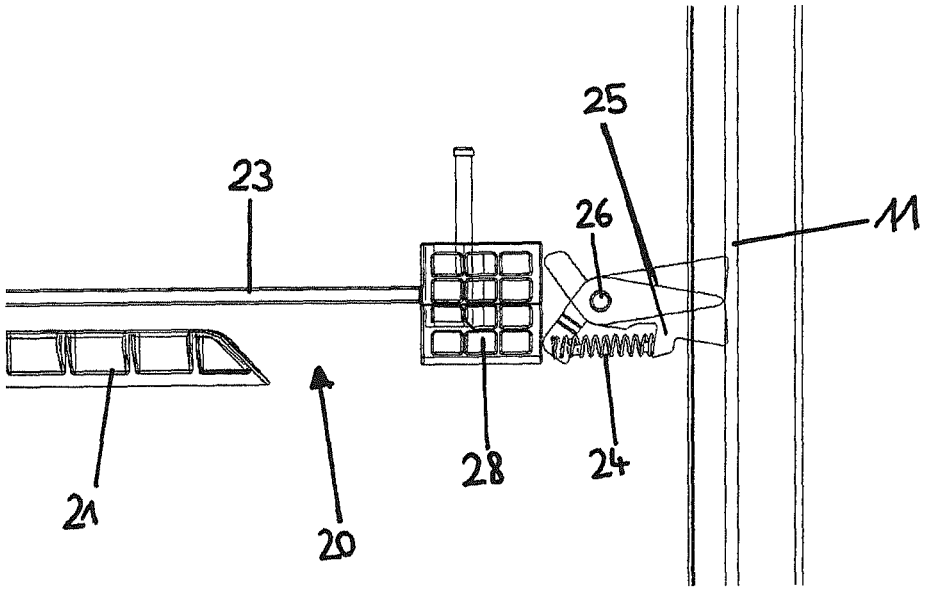
FIG. 2 shows individual elements of the high chair according to FIG. 1.
Figure 3:
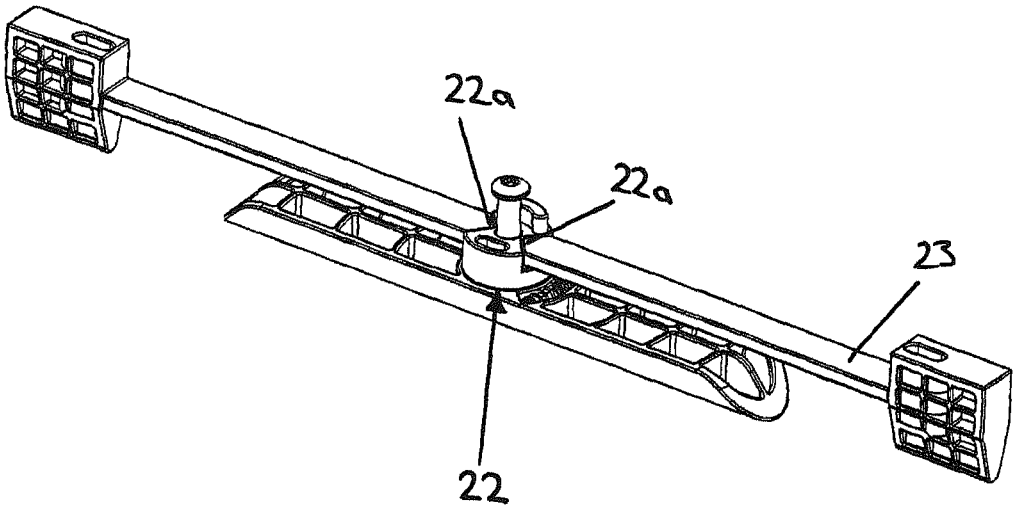
FIG. 3 shows individual elements of the high chair according to FIG. 1 in an oblique view.

The seating surface 12 generally comprises a (symmetrical) locking device 20. The locking device 20 has an actuating device (lever) 21 and a stabilization strut or a housing 27. A force-transmission device (rod) 23, a spring 24, a bearing element 28 (at the end of the force-transmission device 23), which may be constructed as a pressure plate, and two bolt elements 25 or clamping devices 25 (cf. FIGS. 2 and 3) are provided on each side of the locking device.

The spring tensions the bolt elements 25 with respect to one another in a locked state, wherein these bolt elements 25 are brought into engagement with an (assigned) leg 11 of the high chair 10, actually with a groove 29 provided there. If the locking device 20 is in a locked state, the actuating device 21 can be constructed to be (at least substantially) parallel with the housing 27 and, if appropriate, form a flush surface with this housing.

The actuating device 21 has a (round) central section 22 and (in the present case two) recesses 22*a*, wherein each recess 22*a* is in engagement with one of the force-transmission devices 23 (rods) in the locked state. The bolt elements 25 (on each side) are mounted on the housing 27 in a pivotable manner about a common axis 26.

The locking device can be transitioned from a locked state to a released state, in that the actuating device 21 is rotated, so that the force-transmission device 23 is moved outwards (as the force-transmission device 23 can then no longer remain in engagement with the recesses 22*a*). As a result, the bearing device (pressure plate) 28, which is arranged at a distal end of the respective force-transmission device 23, is moved outwards and presses against proximal ends of the bolt elements 25. Owing to this movement, the bolt elements 25 pivot about their (common) axis 26 counter to the tensioning force of the spring 24 and thus are detached from the leg 11.

Due to a rotation of the actuating device 21 (back into their original position) the spring 24 can pivot the bolt elements 25 back, so that these are in turn locked to the leg 11, as in this state, the force-transmission device 23 is in turn in engagement with the recesses 22*a*. As a result, in the case of an upwardly acting force or a downwardly acting force of one of the bolt elements (clamping devices) 25 can come into engagement with the corresponding groove 29 and thus prevent the seating surface 12 from being moved in the force direction.

Figure 4:
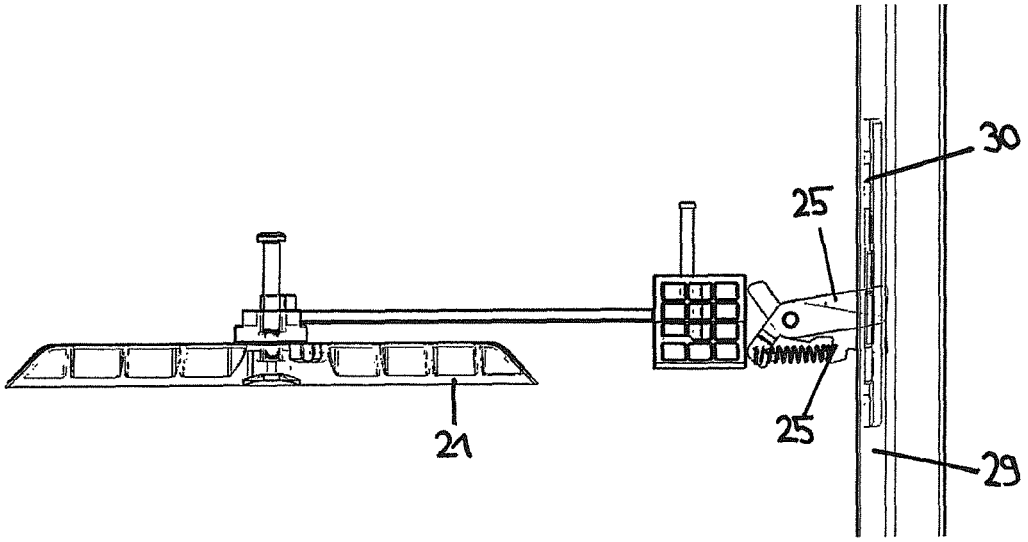
FIG. 4 shows individual elements of a high chair according to the invention in a side view and a first position.

FIG. 4 shows a side view of individual elements of a high chair according to the invention. This may be constructed according to FIGS. 1 to 3, so that FIG. 4 can also be considered as illustrating further details of the high chair according to FIGS. 1 to 3. However, the small slide plate 30 is not illustrated in FIGS. 1 to 3. This small slide plate 30 can optionally be provided (or not) in the embodiment according to FIGS. 1 to 3. Conversely, the small slide plate 30 is indeed illustrated in FIGS. 4 to 7. However, this small slide plate is only optional in the embodiment according to FIGS. 4 to 7 in particular.

Figure 5:
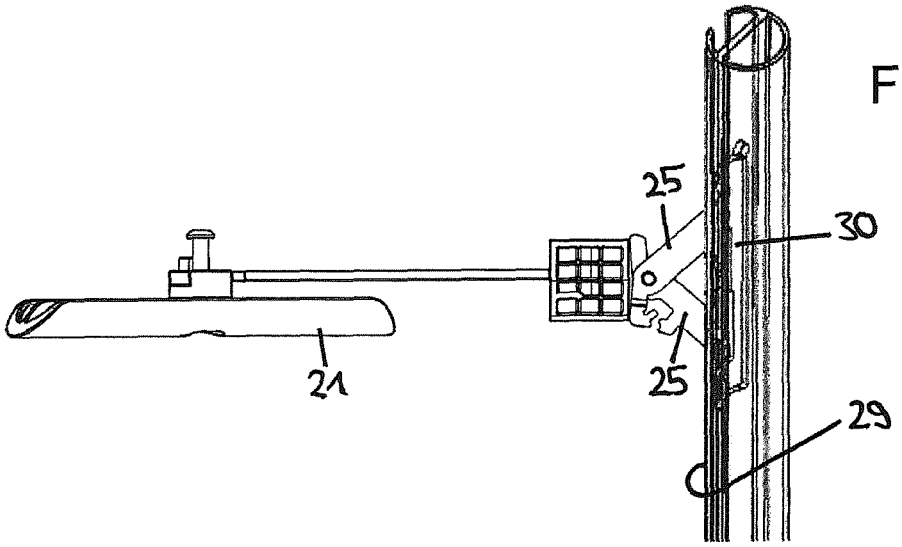
FIG. 5 shows the elements according to FIG. 4 in a side view and a second position.
Figure 6:
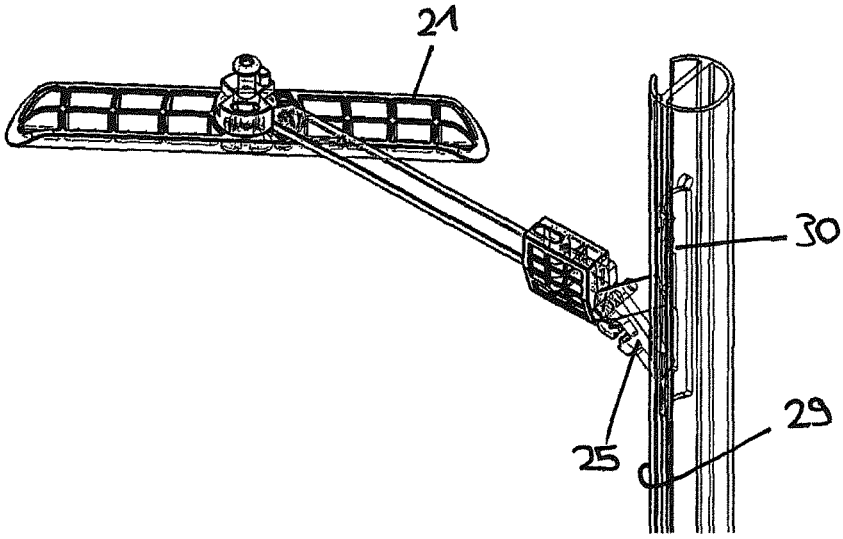
FIG. 6 shows the elements according to FIGS. 4 and 5 in the position according to FIG. 5 and an oblique view.

One can see in FIGS. 4 to 6, that by rotating the actuating device 21, the bolt elements 25 are forced into (cf. FIG. 4) or are guided out of the groove 29 (specifically by means of pivoting, cf. FIGS. 5 and 6). The position according to FIG. 4 corresponds to the position according to FIG. 2.

Figure 7:
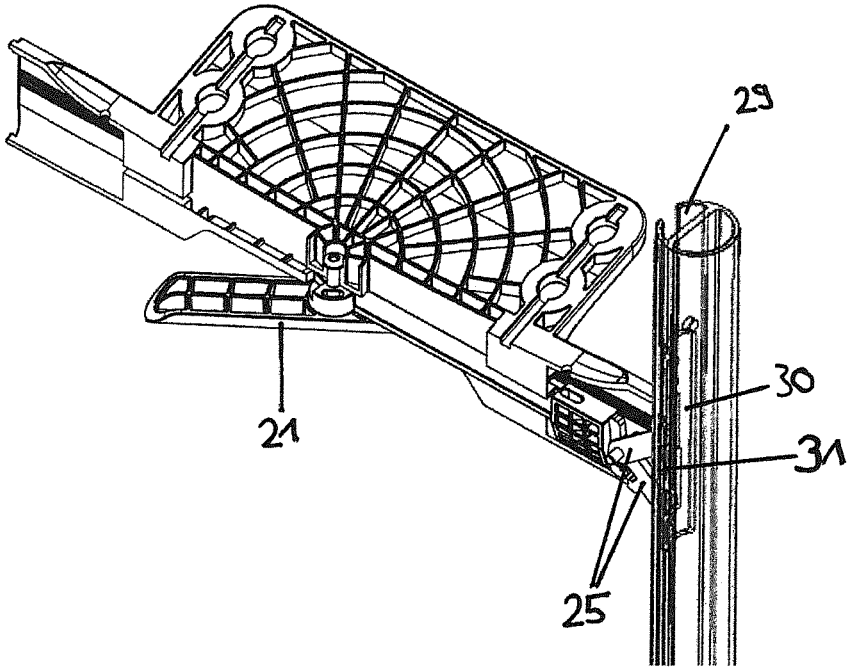
FIG. 7 shows individual elements of the high chair according to FIGS. 4 to 6.

Furthermore, the already mentioned small plate 30 can be seen in FIGS. 4 and 7. The small plate 30 (cf. also FIG. 7) has a slot 31, through which the slide elements 25 (cf. FIG. 4) can penetrate. The small plate 30 moves with a movement of the actuating device 21 (upwards or downwards), so that a reliable guidance of the height adjustment is enabled by means of the small plate 30. The small plate 30 is therefore entrained in the groove 29 (in the case of movement of the actuating device upwards or downwards). According to the implementation, the bolting (locking) is produced between the bar elements 25 and the groove 29. The small plate 30 in particular has a reinforcing or stabilizing effect and improves the guidance in the groove. The small plate preferably does not have (or at best has an insignificant) influence on the bolting (locking) (but this may be different in a potential alternative embodiment).

It is noted at this point that all of the above-described parts, considered separately and in any combination, particularly the details illustrated in the drawings, are claimed as essential for the invention. Modifications thereof are familiar for the person skilled in the art.

REFERENCE NUMBERS

10 High chair
11 Leg
12 Seat
13 Backrest
14 Foot rest
15 Tray area
20 Locking device
21 Actuating device
22 Central section
22*a* Recess
23 Force-transmission device (bar)
24 Spring
25 Bolt element
26 Axis
27 Housing
28 Bearing device
29 Groove
30 Slide plate
31 Slot

The invention claimed is:

1. A seat including a height-adjustable support device for supporting a body part of a child or an external object comprising a height-adjustment device which comprises at least two locking devices, one at each side of the seat, wherein the at least two locking devices can be released or transferred into a locked state by rotation of a common operating device, the common operating device being rotatable relative to a contact surface of the height-adjustable support device, and wherein the locking device comprises at least one bolt element configured for rotation or translational movement; and further including a groove for guiding a height adjustment and wherein the at least one bolt element can slide in the groove in the non-locked state or wherein a slide element is configured to slide in the groove.

2. The seat according to claim 1, wherein the height-adjustment device provides for infinitely variable height adjustment of the support device.

3. The seat according to claim 1, wherein the locking device includes a press fit or clamp.

4. The seat according to claim 1, wherein the support device comprises a seating surface or a foot rest.

5. The seat according to claim 1, further including an actuating device configured for pretension in a direction of a locking position.

6. The seat according to claim 1, wherein a pretensioning spring device is configured to act in the direction of the locked state.

7. The seat according to claim 1, wherein a height adjustment entails two rotatable elements rotated together and guided by a guide groove.

8. The seat according to claim 1, wherein the locking device is configured such that a force in a direction of gravity effects engagement of the locking device into the locked state.

9. The seat according to claim 1, wherein a height adjustment, a locking of the adjusted height, or an ending of the locking of the adjusted height can be carried out one-handed.

10. The seat according to claim 1, wherein a height adjustment, a locking of the adjusted height, or a release of the locking of the adjusted height can be carried out by gripping and operating a centrally arranged handle.

11. The seat according to claim 1, wherein a locking of the adjusted height is at least partially achieved by a force connection.

12. A seat including a height-adjustable support device for supporting a body part of a child or an external object comprising a height-adjustment device which comprises at least two locking devices, one at each side of the seat, wherein the at least two locking devices can be released or transferred into a locked state by rotation of a common operating device, the common operating device being rotatable relative to a contact surface of the height-adjustable support device, and wherein the locking device comprises a groove and at least one bolt element which can be guided into the groove and out of the groove, and is secured in the locked state inside the groove by a press fit or clamp.

13. A seat including a height-adjustable support device for supporting a body part of a child or an external object comprising a height-adjustment device which comprises at least two locking devices, one at each side of the seat, wherein the at least two locking devices can be released or transferred into a locked state by rotation of a common operating device, the common operating device being rotatable relative to a contact surface of the height-adjustable support device, wherein the locking device has two bolt elements configured to be rotated in opposite directions.

14. A seat including a height-adjustable support device for supporting a body part of a child or an external object comprising a height-adjustment device which comprises at least two locking devices, one at each side of the seat, wherein the locking devices can be released or transferred into a locked state by rotation or translation of a common operating device, wherein a guide groove for guiding a height adjustment is formed by a locking groove and wherein a bolt element can slide in the guide groove in the non-locked state or wherein a slide element is configured to slide in the guide groove.

15. A seat including a height-adjustable support device for supporting a body part of a child or an external object comprising a height-adjustment device which comprises at least two locking devices, one at each side of the seat, wherein the locking devices can be released or transferred into a locked state by rotation or translation of a common operating device, wherein the locking device has two bolt elements configured to be rotated in opposite directions between a locked state and an unlocked state for directly producing or releasing the locking.

* * * * *